United States Patent [19]

Sutherland

[11] Patent Number: 4,784,436

[45] Date of Patent: Nov. 15, 1988

[54] TRAVEL CHAIR

[75] Inventor: Garry Sutherland, Edmonds, Wash.

[73] Assignee: Larry A. Peterson, Gig Harbor, Wash.

[21] Appl. No.: 791,752

[22] Filed: Oct. 28, 1985

[51] Int. Cl.[4] ..... A47C 7/00

[52] U.S. Cl. ..... 297/440; 297/441; 297/378; 297/45

[58] Field of Search ..... 297/440, 441, 378, 45, 297/17, 31, 16

[56] References Cited

U.S. PATENT DOCUMENTS

| | | | |
|---|---|---|---|
| 823,199 | 6/1906 | Amann | 297/378 X |
| 2,564,915 | 8/1951 | Nelson | 297/441 X |
| 2,625,988 | 1/1953 | MacMillan | 297/441 |
| 2,871,921 | 2/1959 | Arnold | 297/45 |
| 3,437,375 | 4/1969 | Keffler | 297/441 |
| 3,543,310 | 12/1970 | Smith | 297/441 |
| 4,541,666 | 9/1985 | Vanderminden | 297/31 |
| 4,605,261 | 8/1986 | Lee | 297/17 |

FOREIGN PATENT DOCUMENTS

| | | | |
|---|---|---|---|
| 1265905 | 5/1961 | France | 297/45 |
| 516443 | 2/1955 | Italy | 297/31 |
| 293960 | 7/1928 | United Kingdom | 297/17 |

*Primary Examiner*—Francis K. Zugel

*Attorney, Agent, or Firm*—Roy E. Mattern, Jr.

[57] ABSTRACT

A portable knock down chair carried in a bag, to be used for temporary seating, for example at beaches, wherein most of the major components are substantially of similar C-shape and size. The chair is comprised of a frame assembly of C-supports. A pair of longitudinal elongated C-seat supports each have a pivotal elongated side support for a back hingedly secured thereto and may be pivoted to a substantially perpendicular and upright position during use or folded down parallel to the seat support during non use and storage. A fabric seat and fabric back panel are slidingly positioned on and depend between the opposing seat supports and side supports. Transverse elongated front and rear C-leg supports are removably attached between front and rear depending end portions respectively of the seat support members to elevate the chair approximately nine inches from the ground plane in the preferred embodiment. The transverse elongated C-top support is removably connected between the opposing side supports. Upon disassembling the leg and top supports, the seat supports and hingedly connected side supports with their respective fabric seat and back panels remain intact as a subassembly. The seat supports are rolled about the fabric panels and bunched with the disconnected leg and top supports for placement into the cylindrical bag for storage and transport.

4 Claims, 2 Drawing Sheets

TRAVEL CHAIR

BACKGROUND

A variety of portable and temporary seating or reclining equipment has been developed in recent years, adapted for easy transport and convenient storage. In addition back rests and similar support devices have been developed for use in connection with existing bench seats.

Vanderminden, U.S. Pat. No. 4,541,666 and Arnold, U.S. Pat. No. 2,871,921 both disclose foldable or collapsible chairs. Vanderminden provides a small sand chair having a fabric seat and back and relatively short leg support members thereby supporting a person in the sitting position relatively close to the ground plane.

Smith, U.S. Pat. No. 3,543,310 and Nelson, U.S. Pat. No. 2,564,915 both disclose structures that may be dissembled to a limited extent to allow for easier storage. Smith discloses a cot which incorporates an elongated frame structure having a U-shaped leg member at each of the opposite ends. Nelson discloses a lawn chair having demountable sides and C-shaped cross members.

MacMillan, U.S. Pat. No. 2,625,988 and Amann, U.S. Pat. No. 823,199 disclose portable back rests which are attachable to existing plane like or bench seats. In the Amann invention, the pivotal back support member is secured to perpendicular braces or seat clamps to provide an easily portable attachment particularly for use with plank or bench seating.

Guylott, U.K. Pat. No. 293,960 discloses a fabric lounge chair whereby the fabric seat and back panel incorporates an attached enclosure means whereby the panel can be rolled up and hand carried. A strap is attached to the fabric to facilitate carrying.

A review of the cited references and patents indicates that notwithstanding the prior inventions, there remains a need for a chair sized and adapted for convenient carrying and storage. Existing products evidenced by the prior art failed to meet the need of a chair having frame components which are substantially the same shape and size wherein all components of the chair could be easily and quickly assembled and disassembled and thereafter enclosed within a bag for storage and transport with the packaged bundle being lightweight and less than 24 inches in length.

SUMMARY OF THE INVENTION

A portable knock down chair for temporary seating, at the beach for example, wherein the major components of the chair are substantially the same shape. The chair comprises a frame assembly of support members each being substantially equal in length and sized for easy storage and transport in a small cylindrical bag less than 24 inches in length. The frame assembly comprises a pair of elongated C-seat supports each having an attached pivotal side support to secure a back. A transverse C-leg support is secured between the opposing front and rear depending end portions of the seat supports respectively. A transverse C-top support is connected between the respective pivotal side supports. Fabric seat and back panels are removably secured between the C-seat supports and pivotal side supports respectively.

The C-seat supports and attached pivotal side supports and their respective fabric seat and back panels attached thereto remain in a collapsible subassembly which can be quickly rolled up as a unit for storage when the leg and top support members are easily detached from the chair. The frame assembly components are especially lightweight having no sharp edges, each C-shaped member being preferably less than 20 inches in length to provide a compact bundle within the carrying bag for transportation and storage. The C-shaped tubular configuration of the C-leg supports keeps the bearing surface of the leg support from being buried in the sand during use on a beach and enables the occupant to remain supported above the sand.

DESCRIPTION OF THE PREFERRED EMBODIMENTS

Figure 1:
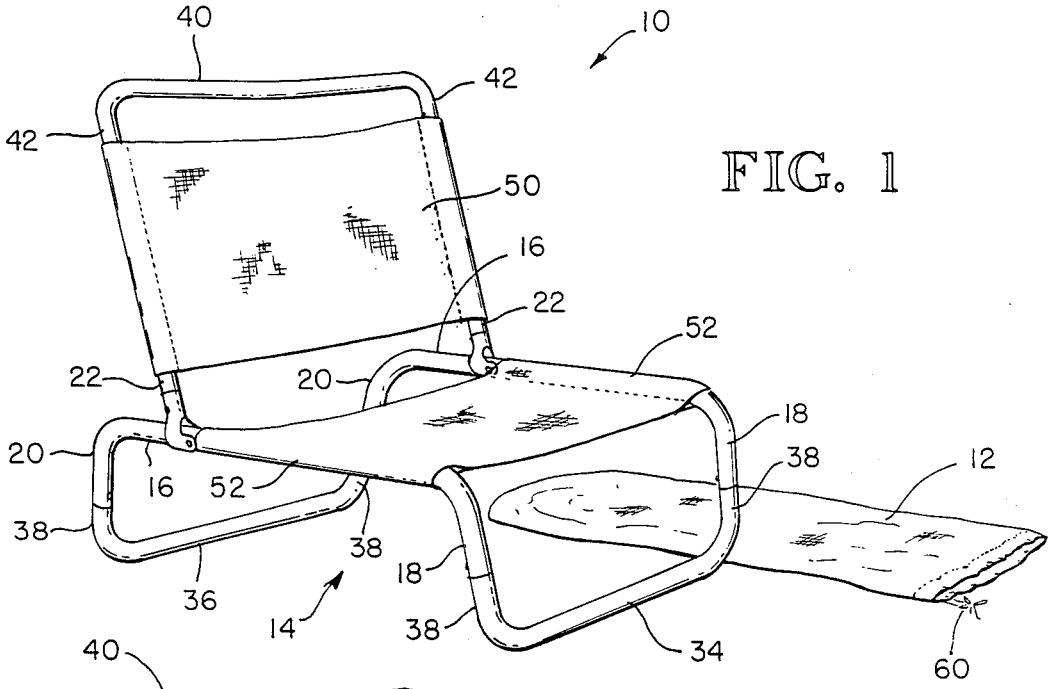
FIG. 1 is a perspective view of the chair as may be used on beach sand for example.

A portable knock down chair 10 is provided for use as temporary seating, for example at a beach, shown in FIG. 1, being adapted for quick assembly and disassembly and further adapted for transport and storage in a compact bundle enclosed within a cylindrical bag 12 which is preferably 20 inches in length and 7 inches in diameter.

Figure 3:
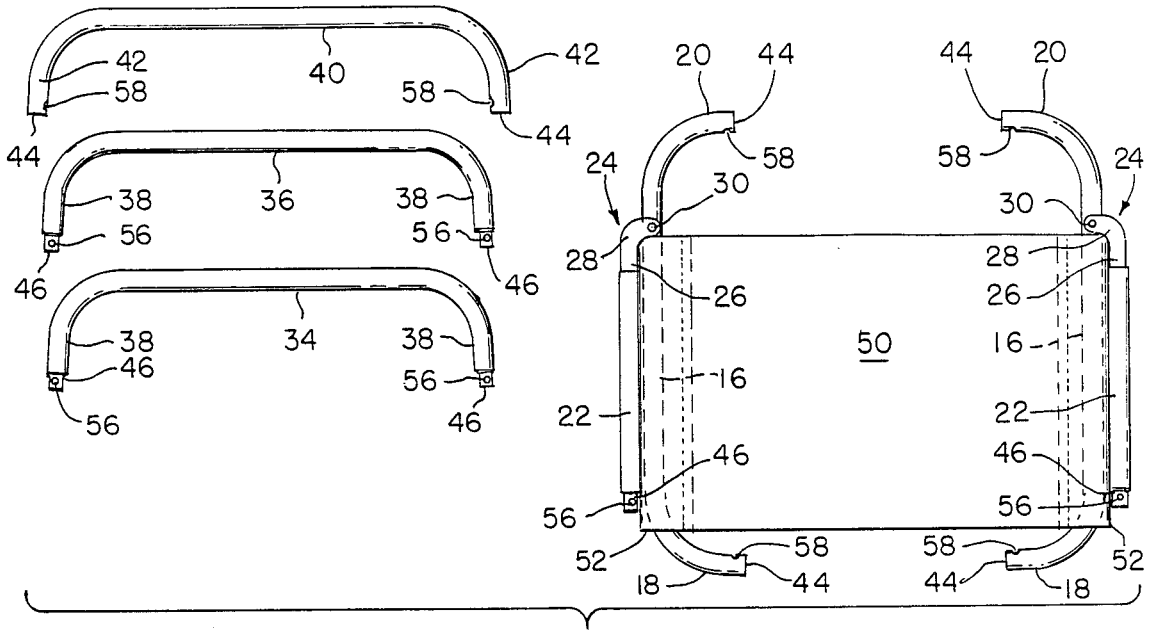
FIG. 3 is a perspective view of the chair showing the top and leg C-supports and subassembly of the seat and side supports with their attached fabric panels, the chair back being in the folded position. After initial assembly, the subassembly remains intact with no further breakdown of the chair. The top and leg support and subassembly as shown, are then assembled and disassembled during subsequent use.
Figure 4:
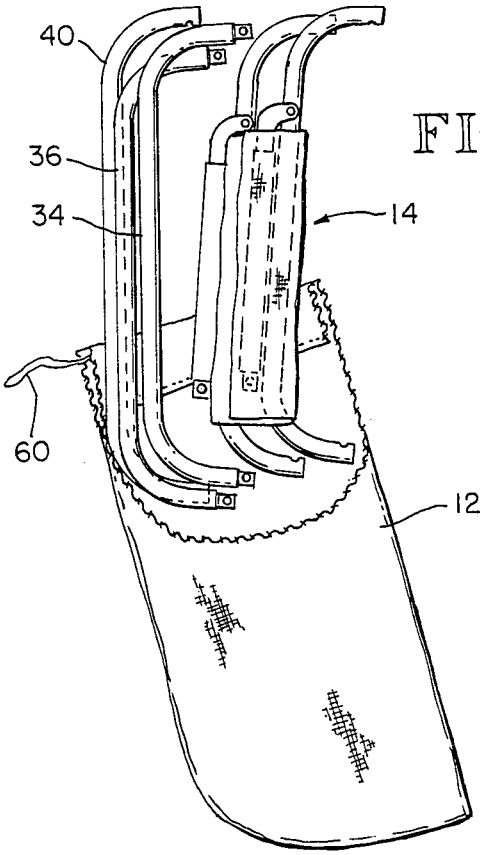
FIG. 4 is a side view of the individual frame supports being C-shaped and substantially equal in length bunched together prior to being inserted into the bag for storage.

The Frame Assembly of the Chair Comprises Members Substantially of Similar Shape The chair 10 comprises a frame assembly preferably made of lightweight hollow metal tubing wherein most of the major frame components of the chair are substantially of equal length and a similar C-shape configuration as shown in FIGS. 3 and 4.

The frame assembly further comprises a pair of longitudinal elongated C-seat supports 14 or seat supports 14, each having a horizontal portion 16 and a front 18 and rear 20 depending end portion as shown in FIGS. 1 through 4 of the drawings. Each seat support 14 further has a pivotal elongated side support 22 attached thereto by a hinge stop 24 located near the rear depending end portion 20 of the seat support 14. Each hinge stop 24 is preferably tubular shaped in construction at its top end 26 and adapted to receive the bottom portion of its respective side support 22. The hinge stop 24 is U-shaped at its other end having depending ears 28 which are in turn pivotally secured to the opposite sides of the seat support by an elongated rivet 30 or bolt shown in FIG. 2. The pivotal side supports 22 provide structural support for a chair back comprising a fabric back panel 50. The horizontal portions 16 of the seat supports 14 in turn provide the structural support for a chair seat, comprising a fabric seat panel 48.

Figure 2:
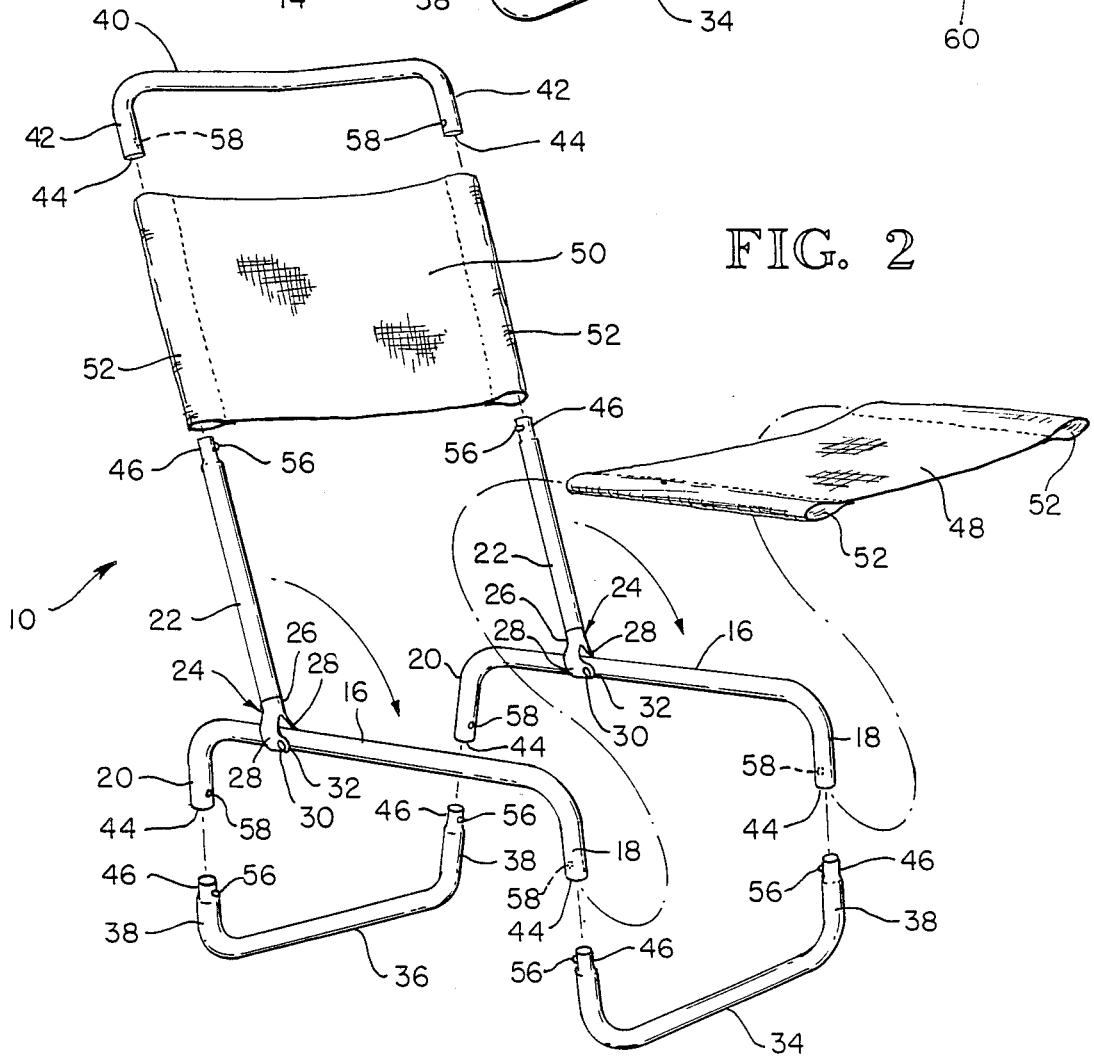
FIG. 2 is an exploded view of the chair.

The legs of the chair 10 comprise transverse elongated C-front 34 and rear 36 leg supports each having depending sides 38 as shown in FIGS. 1 to 3. The leg supports 34 and 36 are adapted for extension between and removable attachment at their depending sides 38 to the opposing respective front 18 and rear 20 depending end portions of the seat supports as shown in FIGS. 1 and 2. A transverse elongated C-top support 40 or top support 40 extends between and is removably connected via depending sides 42 to the respective pivotal side supports 22 thereby completing the structural frame for the chair back. The top support 40 is outwardly cambered slightly to provide sufficient space for depression of the fabric back panel 50 when the chair 10 is in use.

Each of the depending sides of the leg and side supports have tapered open ends 46 for connectable insertion into the larger diameter of the open ends 44 of the depending end portions 18 and 20 of the seat supports 14 and depending sides 42 of the top supports 40 respectively thereby forming telescoping joints 54 to removably interconnect the seat supports 14 and side supports 22 with their respective legs and top support shown in FIGS. 2 and 3. Each tapered open end 46 has a detent spring button 56 depending therefrom adapted to be extended through a corresponding and receiving aperture 58 within the open ends 44 of each respective depending end portions 18 and 20 of the seat supports 14 and depending side 42 of the top supports 40. Upon engagement of the telescoping joints 54, the detent spring button 56 is pushed in until its corresponding receiving aperture 58 is in alignment whereupon the button 56 provides a locking means for the telescoping joint 54 as shown in FIGS. 2 and 3.

Each of the leg supports, seat supports and top supports all substantially comprise the same C-shape wherein the height of the C of each support, i.e. the length of the applicable depending end portion or depending side is preferably approximately five inches. Interconnecting the seat support 14 with the leg supports 34 and 36 results in the chair 10 being supported roughly nineinches off of the plane surface in its preferred embodiment. The relative equality of size and shape of the frame components allow the chair 10 to be completely disassembled and easily packaged in a small bundle wherein the frame assembly and attached fabric panels are rolled together and inserted into a cylindrical carrying bag 12 for easy storage and transportation. The length of the frame members are each approximately 18 inches allowing for all the components to fit into the cylindrical bag which is less than 24 inches long.

The hinge stops 24 are adapted to engage the horizontal portions 16 of the seat supports 14, preventing further rotation of the pivotal side supports 22 at a position slightly aft of perpendicular shown in FIGS. 1 and 2. The back is thus angled slightly rearward during use for the comfort of the user. Each of the pivotal side supports 22 may be rotated forward until resting in parallel alignment against the horizontal portions 16 of the seat support 14 during non use for storage.

Fabric Seat and Back Panels

Both fabric back 50 and seat 48 panels have folded over sewn sleeves 52 at each of their opposite ends for slide on installation over the seat support 14 and side support 22 members respectively as shown in FIG. 2. The sleeves 52 of the fabric seat panel 48 slide over the opposite front depending end portions 18 of the seat supports 14 prior to installation of the front leg support 34 whereby the seat panel 48 is supportively positioned between the horizontal portions 16 of the seat supports 14, shown in FIGS. 1–3. Similarly the fabric back panel 50 is slidingly positioned over the respective pivotal side supports 22, prior to installation of the top support 40, shown in FIG. 2. Once the fabric panels are positioned on the frame members, the top 40 and leg supports 34 and 36 are snapped into position thereby preventing the panels from slipping off. The panels may be removed for replacement or washing as necessary but are intended to remain attached to their respective seat and side supports as a sub assembly as discussed below. The fabric panels are preferable made of a heavy canvas or high strength synthetic material such as nylon.

Figure 5:
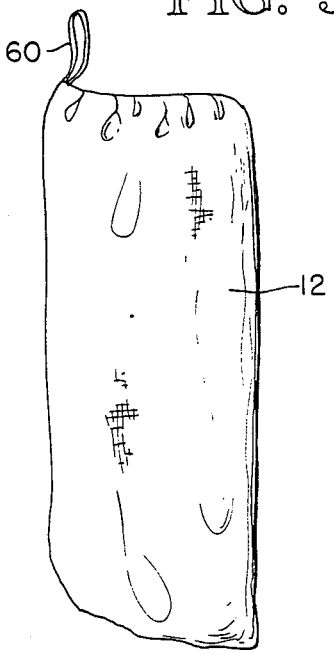
FIG. 5 is a side view of the cylindrical bag.

A Sub Assembly Comprises the Seat and Side Supports and Respective Fabric Seat and Back Panels To facilitate assembling and disassembling of the chair 10, the seat supports 14 and pivotally attached side supports 22 with their respective fabric seat panel 48 and fabric back panel 50 remain intact as a subassembly rather than requiring removal and replacement of the fabric panels with each usage of the chair. As shown in FIGS. 3 and 4, the side supports 22 may be rotatably folded down to rest against the seat supports 14 then being rolled together and still loosely connected by the fabric panels in a convenient bundle. The top and leg supports are then combined with the subassembly to fit neatly into the carrying bag 12 secured by a drawstring 60 shown in FIGS. 4 and 5.

The frame members are preferably constructed of a light gauge aluminum but may also be made of a composite material, plastic or steel in the alternative.

What is claimed is:

1. A portable knock-down chair having a plurality of components for easy assembly and disassembly, comprising:

(a) a first longitudinal C-shaped seat support having a horizontal portion and a front and rear depending end portions;

(b) a second longitudinal C-shaped seat support having a horizontal portion and a front and rear depending end portions;

(c) a side support for each of said seat support having first and second ends, said first end including hinge means for pivotally connecting said first end to adjacent the rear end portion of one of said seat supports, and having a first position disposed generally transverse to the associated horizontal portion and a second position substantially contiguous with the associated horizontal portion of said seat support;

(d) a longitudinal C-shaped front leg support having depending end portions and adapted for removable attachment to said front depending end portions of said first and second seat supports so that said front leg support extends generally transverse to said seat supports;

(e) a longitudinal C-shaped rear leg support having depending end portions adapted for removable attachment to said rear depending end portions of said first and second seat supports so that said rear leg support extends generally transverse to said seat supports;

(f) C-shaped top support having depending end portions and adapted for removable attachment to the opposite second end of each of said side supports so that said top support extends generally transverse to said seat supports;

(g) said seat, side, leg and top supports being tubular;

(h) each of said seat and top supports having a receiving aperture proximate the end portions thereof;

(i) said depending end portions of said front and rear leg supports being sized for permitting insertion thereof into the ends of said first and second seat supports;

(j) said second ends of said side supports being sized for permitting insertion thereof into said ends of said top support;

(k) each of said ends of said front and rear leg supports and said second ends of said side supports including a spring loaded snap clip removably insertable through an associated receiving aperture in each of said ends of said seat and top supports for thereby locking the components together;

(l) a flexible seat panel having sleeves on two opposing sides adapted to receive the horizontal portion of said first and second seat supports; and (m) a flexible back panel having sleeves on two opposing sides adapted to receive respective said side supports.

2. A portable knock-down chair, as in claim 1, and further comprising:

(a) a cylindrical bag adapted to receive the components of said knock-down chair in disassembled condition.

3. A portable knock-down chair, as in claim 1, wherein:

(a) each of said end portions of said leg and side supports has reduced diameter smaller than the diameter of the central portion of said supports;

(b) said spring loaded snap clips are positioned in said reduced diameter portion.

4. A portable knock-down chair, as in claim 1, wherein:

(a) said hinge means includes first and second generally transverse portions;

(b) each first portion is connected to an associated side support; and (c) each second portion is pivotally connected to an associated seat support.

* * * * *